US005457523A

United States Patent [19]

Facci et al.

[11] Patent Number: 5,457,523

[45] Date of Patent: Oct. 10, 1995

[54] FERROFLUID MEDIA CHARGING OF PHOTORECEPTORS

[75] Inventors: John S. Facci; Ronald F. Ziolo; Martin A. Abkowitz, all of Webster; Milan Stolka, Fairport; Richard B. Lewis, Williamson; Michael J. Levy, Webster, all of N.Y.

[73] Assignee: Xerox Corporation, Stamford, Conn.

[21] Appl. No.: 250,090

[22] Filed: May 27, 1994

[51] Int. Cl.[6] ..... G03G 15/02

[52] U.S. Cl. ..... 355/219; 250/324

[58] Field of Search ..... 355/219, 221; 250/324, 325, 326

[56] References Cited

U.S. PATENT DOCUMENTS

| | | | |
|---|---|---|---|
| 2,904,431 | 9/1959 | Moncrieff-Yeates | 96/1 |
| 2,987,660 | 6/1961 | Walkup | 317/262 |
| 3,394,002 | 7/1968 | Bickmore | 96/1 |
| 4,762,997 | 8/1988 | Bergen | 250/326 |

FOREIGN PATENT DOCUMENTS

| | | | |
|---|---|---|---|
| 59-48785 | 3/1984 | Japan | 355/219 |
| 59-61858 | 4/1984 | Japan | 355/219 |
| 4-109262 | 4/1992 | Japan | 355/219 |
| 5-297683 | 11/1993 | Japan | 355/219 |

*Primary Examiner*—Fred L. Braun
*Attorney, Agent, or Firm*—Denis A. Robitaille

[57] ABSTRACT

A device for applying an electrical charge to a charge retentive surface by transporting ions in a fluid media and transferring the ions to the member to be charged across the fluid media/charge retentive surface interface. The fluid media is positioned in contact with a charge retentive surface for depositing ions onto the charge retentive surface. In one specific embodiment, the fluid media is a ferrofluid material wherein a magnet is utilized to control the position of the fluid media, which, in turn, can be utilized to selectively control the activation of the charging process.

11 Claims, 3 Drawing Sheets

FERROFLUID MEDIA CHARGING OF PHOTORECEPTORS

The present invention relates generally to an apparatus for depositing a substantially uniform charge on an adjacent surface, and, more particularly, concerns an apparatus for enabling ion transfer via ionic conduction through a fluid media, primarily for use in electrostatographic applications, for example, to charge an imaging member such as a photoreceptor or a dielectric charge receptor.

Generally, the process of electrostatographic reproduction is initiated by exposing a light image of an original document to a substantially uniformly charged photoreceptive member. Exposing the charged photoreceptive member to a light image discharges the photoconductive surface thereof in areas corresponding to non-image areas in the original document, while maintaining the charge on image areas to create an electrostatic latent image of the original document on the photoreceptive member. This latent image is subsequently developed into a visible image by a process in which a charged developing material is deposited onto the photoconductive surface of the photoreceptor such that the developing material is attracted to the charged image areas on the photoconductive surface. Thereafter, the developing material is transferred from the photoreceptive member to a copy sheet or some other image support substrate to which the image may be permanently affixed for producing a reproduction of the original document. In a final step in the process, the photoconductive surface of the photoreceptive member is cleaned to remove any residual developing material therefrom in preparation for successive imaging cycles.

The above described electrostatographic reproduction process is well known and is useful for light lens copying from an original, as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images.

Various devices and apparatus have been proposed for use in electrostatographic applications to apply an electrostatic charge or a charge potential to a photoconductive surface prior to the formation of a light image thereon. Typically, corona generating devices are utilized, wherein a suspended electrode comprising one or more fine conductive elements is biased at a high electric potential, causing ionization of surrounding air which results in deposition of an electric charge on an adjacent surface. One example of such a corona generating device is described in U.S. Pat. No. 2,836,725, to R. G. Vyverberg, wherein a conductive corona electrode in the form of an elongated wire is partially surrounded by a conductive shield. The corona electrode is provided with a DC voltage, while the conductive shield is usually electrically grounded. A dielectric surface to be charged is spaced from the wire on the side opposite the shield and is mounted on a grounded substrate. Alternatively, the corona device may be biased in a manner taught in U.S. Pat. No. 2,879,395, wherein an AC corona generating potential is applied to the conductive wire electrode and a DC potential is applied to a conductive shield partially surrounding the electrode. This DC potential regulates the flow of ions from the electrode to the surface to be charged. Because of this DC potential, the charge rate can be adjusted, making this biasing system ideal for self regulating systems. Other biasing arrangements are known in the prior art and will not be discussed in great detail herein.

In addition to charging the imaging surface of an electrostatographic system prior to exposure, corona generating devices, so-called corotrons, can be used in the transfer of an electrostatic toner image from a photoreceptor to a transfer substrate, in tacking and detacking paper to or from the imaging member by neutralizing charge on the paper, and, generally, in conditioning the imaging surface prior to, during, and after the deposition of toner thereon to improve the quality of the xerographic output copy.

Several problems have historically been associated with corona generating devices as described hereinabove. The most notable problem centers around the inability of such corona devices to provide a uniform charge density along the entire length of the corona generating electrode, resulting in a corresponding variation in the magnitude of charge deposited on associated portions of the adjacent surface to be charged. Other problems include the use of very high voltages (6000–8000 V) requiring the use of special insulation, maintenance of corotron wires, low charging efficiency, the need for erase lamps and lamp shields and the like, arcing caused by non-uniformities between the coronode and the surface being charged, vibration and sagging of corona generating wires, contamination of corona wires, and, in general, inconsistent charging performance due to the effects of humidity and airborne chemical contaminants on corona devices. More importantly, corona devices generate ozone, resulting in well-documented health and environmental hazards. Corona charging devices also generate oxides of nitrogen which eventually desorb from the corotron and oxidize various machine components, thereby adversely effecting the quality of the final output print.

Various approaches and solutions to the problems inherent to the use of suspended wire corona generating charge devices have been proposed. For example, U.S. Pat. No. 4,057,723 to Sarid et al. shows a dielectric coated coronode uniformly supported along its length on a conductive shield or on an insulating substrate. That patent shows a corona discharge electrode including a conductive wire coated with a relatively thick dielectric material, preferably glass or an inorganic dielectric, in contact with or spaced closely to a conductive shield electrode. U.S. Pat. No. 4,353,970 discloses a bare wire coronode attached directly to the outside of a glass coated secondary electrode. U.S. Pat. No. 4,562,447 discloses an ion modulating electrode that has a plurality of apertures capable of enhancing or blocking the passage of ion flow through the apertures. In addition, alternatives to corona generating charging systems have been developed. For example, roller charging systems, as exemplified by U.S. Pat. Nos. 2,912,586 to Gundlach; 3,043,684 to Mayer; 3,398,336 to Martel et al., have been disclosed and discussed in numerous articles of technical literature.

The present invention relates to a device for charging photoconductive imaging members by ionic conduction through a fluid media, wherein corona generating devices together with their known disadvantages can be avoided. The following disclosures may be relevant to various aspects of the present invention:

U.S. Pat. No. 2,904,431 Patentee: Moncrieff-Yeates Issued: Sep. 15, 1959

U.S. Pat. No. 2,987,660 Patentee: Walkup Issued: Jun. 6, 1961

U.S. Pat. No. 3,394,002 Patentee: Bickmore Issued: Jul. 23, 1968

The relevant portions of the foregoing disclosures may be briefly summarized as follows:

U.S. Pat. No. 2,904,431 discloses a method and apparatus for providing electrical connection to a body of semi-conductive or dielectric material, wherein the method comprises closely spacing the surface of an electrode from the surface of the body to which connection is to be made with a film forming liquid. When a voltage is applied to the electrode, an electric field is generated across the liquid film, causing the liquid to behave as a conductor transversely through the layer while continuing to behave as an insulator in the lateral direction. That patent includes a method of electrically charging the surface of a body of semi-conductive or dielectric material.

U.S. Pat. No. 2,987,660 discloses a xerographic charging process for applying an electric charge to the surface of an insulating or photoconductive insulating layer by electrification with a conductive or electrolytic liquid wherein the charge applied is of substantially the same potential as the potential on the contacting liquid and is substantially uniform across the entire area being charged.

U.S. Pat. No. 3,394,002 discloses a method of applying charge onto an electrically insulating surface utilizing a liquid of high resistivity across which an electrostatic image is transferred. More particularly, that patent relates to the chemical doping of liquid materials utilized in various electrostatic imaging systems whereby the electrical charge transfer characteristics thereof are controlled for effecting image charge transfer between juxtaposed surfaces of different imaging materials.

In accordance with the present invention, an apparatus for charging a member is disclosed, comprising a fluid media; means for storing the fluid media; means for contacting the fluid media with the member to be charged; and means for applying an electrical bias to the fluid media, wherein the electrical bias transports ions through said fluid media to the member to be charged for transferring ions thereto.

In accordance with another aspect of the invention, an electrostatographic printing machine is provided, including a charging device for applying an electrical charge to an imaging member, comprising a fluid media; means for storing the fluid media; means for contacting the fluid media with the imaging member; and means for applying an electrical bias to the fluid media, wherein the electrical bias transports ions through the fluid media to the imaging member for transferring ions thereto.

These and other aspects of the present invention will become apparent from the following description in conjunction with the accompanying drawings in which.

While the present invention will be described in connection with a preferred embodiment thereof, it will be understood that it is not intended that the invention be limited to this preferred embodiment. On the contrary, the present invention is intended to cover all alternatives, modifications, and equivalents as may be included within the spirit and scope of the invention as defined by the appended claims.

Figure 4:
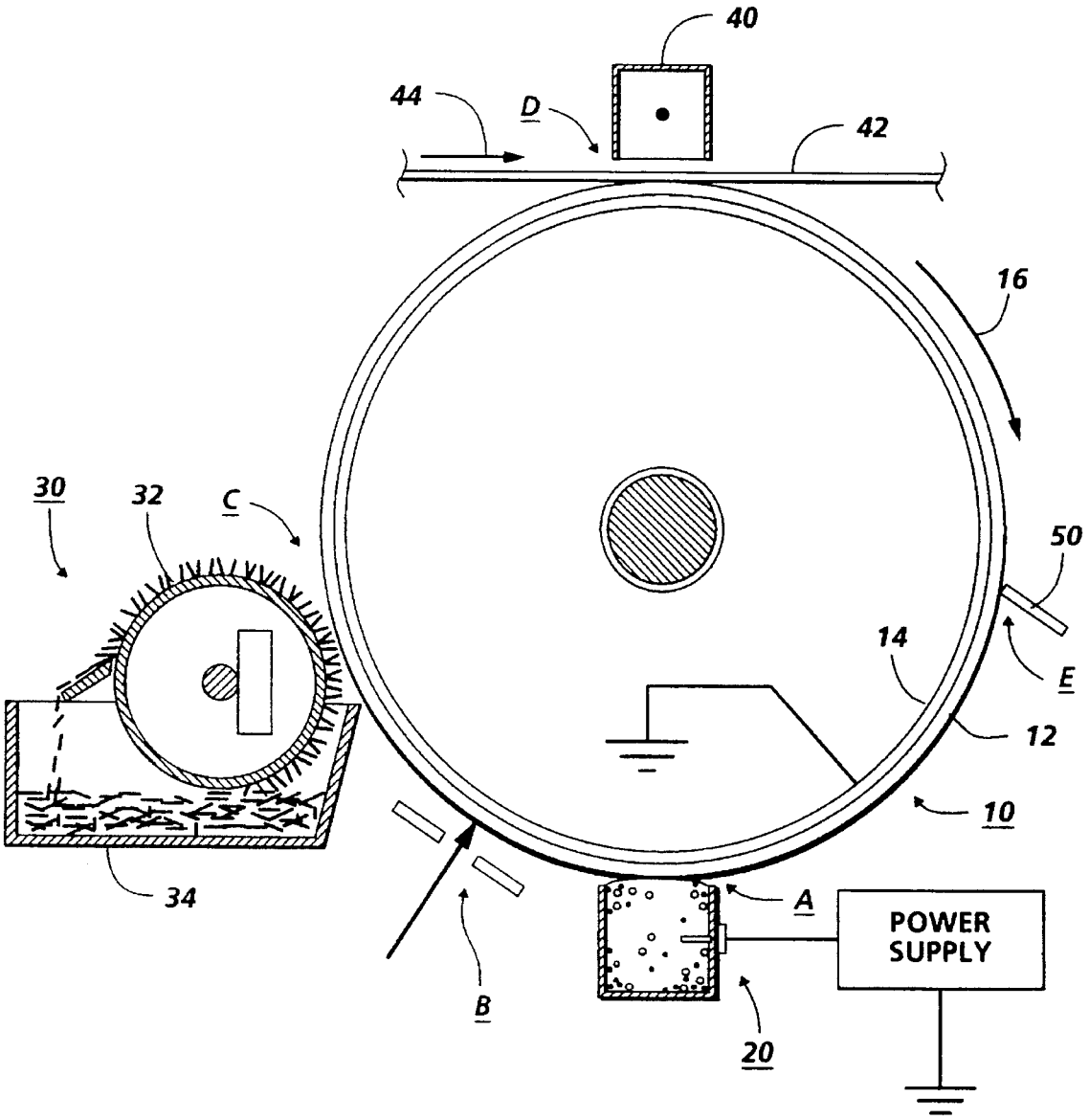
FIG. 4 is a schematic elevational view showing an electrophotographic copier employing the features of the present invention.

For a general understanding of the features of the present invention, reference is made to the drawings wherein like reference numerals have been used throughout to designate identical elements. Referring initially to FIG. 4 prior to describing the invention in detail, a schematic depiction of the various components of an exemplary electrophotographic reproducing apparatus incorporating the fluid media charging structure of the present invention is provided. Although the apparatus of the present invention is particularly well adapted for use in an automatic electrophotographic reproducing machine, it will become apparent from the following discussion that the present fluid media charging structure is equally well suited for use in a wide variety of electrostatographic processing machines and is not necessarily limited in its application to the particular embodiment or embodiments shown herein. In particular, it should be noted that the charging apparatus of the present invention, described hereinafter with reference to an exemplary charging system, may also be used in a transfer, detack, or cleaning subsystem of a typical electrostatographic apparatus since such subsystems also require the use of a charging device.

The exemplary electrophotographic reproducing apparatus of FIG. 4 employs a drum 10 including a photoconductive surface 12 deposited on an electrically grounded conductive substrate 14. A motor (not shown) engages with drum 10 for rotating the drum 10 to advance successive portions of photoconductive surface 12 in the direction of arrow 16 through various processing stations disposed about the path of movement thereof, as will be described.

Initially, a portion of drum 10 passes through charging station A. At charging station A, a charging structure in accordance with the present invention, indicated generally by reference numeral 20, charges the photoconductive surface 12 on drum 10 to a relatively high, substantially uniform potential. This charging device will be described in detail hereinbelow.

Once charged, the photoconductive surface 12 is advanced to imaging station B where an original document (not shown) is exposed to a light source for forming a light image of the original document which is focused onto the charged portion of photoconductive surface 12 to selectively dissipate the charge thereon, thereby recording an electrostatic latent image corresponding to the original document onto drum 10. One skilled in the art will appreciate that a properly modulated scanning beam of energy (e.g., a laser beam) may be used to irradiate the charged portion of the photoconductive surface 12 for recording the latent image thereon.

After the electrostatic latent image is recorded on photoconductive surface 12, drum 10 is advanced to development station C where a magnetic brush development system, indicated generally by the reference numeral 30, deposits developing material onto the electrostatic latent image. The magnetic brush development system 30 includes a single developer roller 32 disposed in developer housing 34. Toner particles are mixed with carrier beads in the developer housing 34, creating an electrostatic charge therebetween which causes the toner particles to cling to the carrier beads and form developing material. The developer roller 32 rotates to form a magnetic brush having carrier beads and toner particles magnetically attached thereto. As the magnetic brush rotates, developing material is brought into contact with the photoconductive surface 12 such that the latent image thereon attracts the toner particles of the developing material, forming a developed toner image on photoconductive surface 12. It will be understood by those of skill in the art that numerous types of development systems could be substituted for the magnetic brush development system shown herein.

After the toner particles have been deposited onto the electrostatic latent image for development thereof, drum 10 advances the developed image to transfer station D, where a sheet of support material 42 is moved into contact with the developed toner image via a sheet feeding apparatus (not shown). The sheet of support material 42 is directed into contact with photoconductive surface 12 of drum 10 in a timed sequence so that the developed image thereon contacts the advancing sheet of support material 42 at transfer station D. A charging device 40 is provided for creating an electrostatic charge on the backside of sheet 42 to aid in inducing the transfer of toner from the developed image on photoconductive surface 12 to a support substrate 42 such as a sheet of paper. While a conventional coronode device is shown as charge generating device 40, it will be understood that the fluid media charging device of the present invention can be substituted for the corona generating device 40 for providing the electrostatic charge which induces toner transfer to the support substrate materials 42. The support material 42 is subsequently transported in the direction of arrow 44 for placement onto a conveyor (not shown) which advances the sheet to a fusing station (not shown) which permanently affixes the transferred image to the support material 42 creating a copy or print for subsequent removal of the finished copy by an operator.

Invariably, after the support material 42 is separated from the photoconductive surface 12 of drum 10, some residual developing material remains adhered to the photoconductive surface 12. Thus, a final processing station, namely cleaning station E, is provided for removing residual toner particles from photoconductive surface 12 subsequent to separation of the support material 42 from drum 10. Cleaning station F can include various mechanisms, such as a simple blade 50, as shown, or a rotatably mounted fibrous brush (not shown) for physical engagement with photoconductive surface 12 to remove toner particles therefrom. Cleaning station F may also include a discharge lamp (not shown) for flooding the photoconductive surface 12 with light in order to dissipate any residual electrostatic charge remaining thereon in preparation for a subsequent imaging cycle. As will be described, the present invention may also be utilized as a substitute for such a discharge lamp to counter any residual electrostatic charge on the photoconductive surface 12.

The foregoing description should be sufficient for purposes of the present application for patent to illustrate the general operation of an electrophotographic reproducing apparatus incorporating the features of the present invention. As described, an electrophotographic reproducing apparatus may take the form of any of several well known devices or systems. Variations of the specific electrostatographic processing subsystems or processes described herein may be expected without affecting the operation of the present invention.

Figure 1:
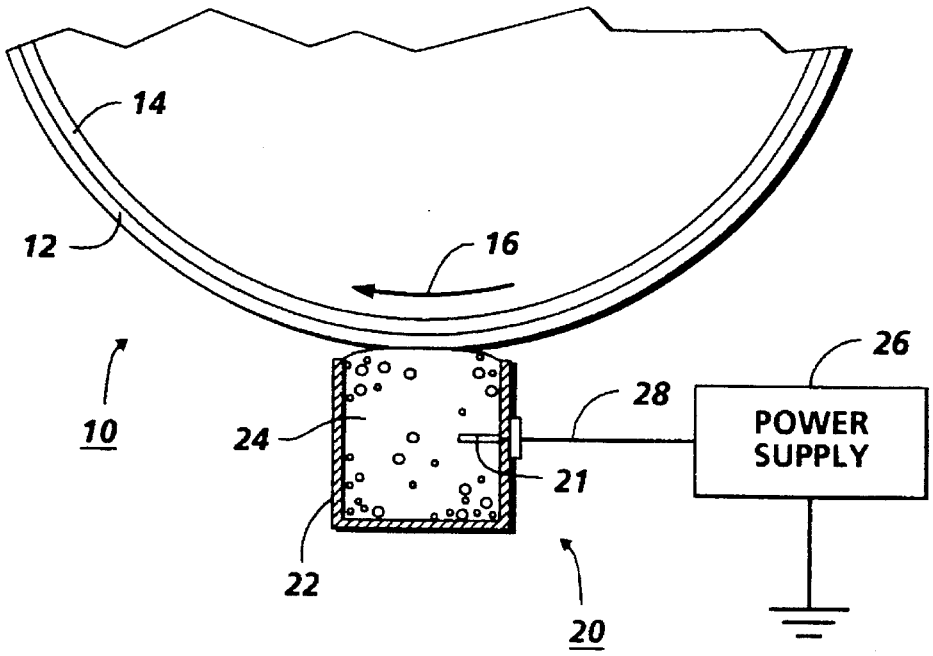
FIG. 1 is a schematic side view of the fluid media charging device of the present invention.
Figure 2:
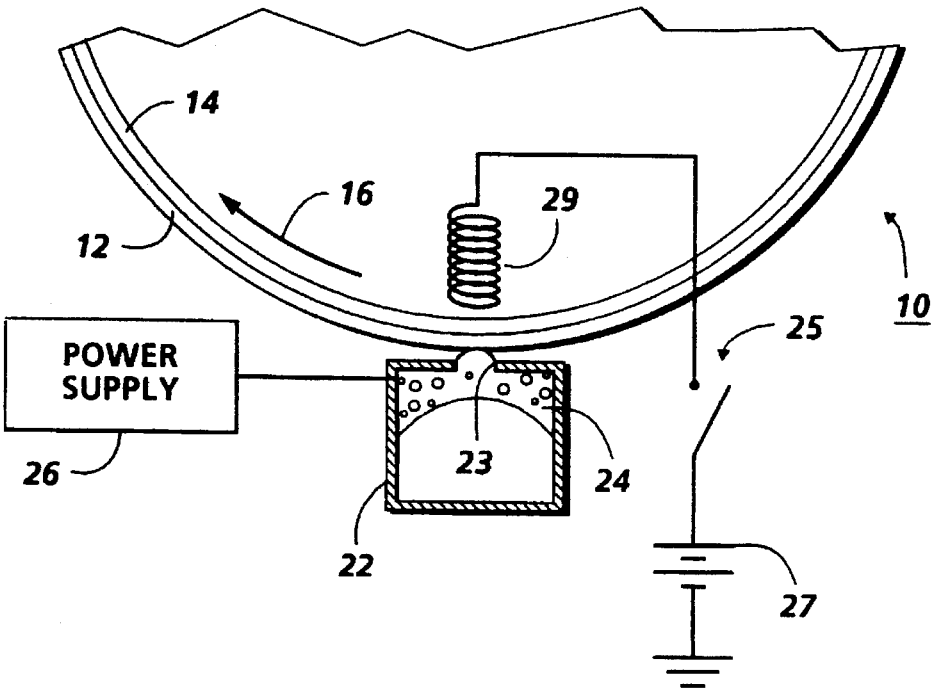
FIG. 2 is a view of an alternative embodiment of the fluid media charging device of the present invention.

Referring now more particularly to FIGS. 1 and 2 and to the specific subject matter of the present invention, an exemplary fluid media charging device 20 is illustrated and will be described in greater detail. The primary components of the fluid media charging structure 20 are a fluid reservoir 22 for placing the fluid media 24 in contact with the photoconductive surface 12 of the drum 10, and a DC voltage power supply 26 coupled to the fluid reservoir 22 for applying a DC voltage bias to the fluid media 24.

In the embodiment of FIG. 1, the fluid reservoir 22 comprises a simple beaker or other vessel for containing an ionically conductive fluid media 24. A conductor 28, such as a copper wire, is coupled to a DC voltage power supply and is contacted with the fluid media 24 in order to apply an ion producing bias voltage to the fluid media 24. Contact between the fluid media 24 and the conductor 28 may be facilitated by a conductive nipple 21 extending into reservoir 22 and capable of being coupled to conductor 28. Alternatively, the fluid reservoir 22 may include a container fabricated of brass, stainless steel or any other conductive material or conductive composite materials such as a carbon loaded polymer or plastic, wherein a conductor is merely placed in contact with the fluid reservoir (as shown in FIG. 2) in order to apply a voltage bias to the fluid media. The conductivity of this conductive fluid reservoir can be as low as about 2 nano-mho/cm. Thus, electrical contact can be made to the ionically conductive fluid either by immersing a wire or other electrical contact element into the fluid if the fluid reservoir 22 is made of an electrically insulating material (as shown in FIG. 1), or by applying a biasing voltage directly to the fluid container if the fluid reservoir 22 is made of a conductive material (as shown in FIG. 2).

Examples of ionically conductive liquid which may serve as the fluid media 24 include any liquid based material capable of conduction of ions, including simple tap water and even distilled deionized water (the conductivity thereof believed to be caused by the known dissolution of carbon dioxide in water). Components which can be added to the water to render it more ionically conductive include atmospheric carbon dioxide ($CO_2$), lithium carbonate, sodium carbonate, potassium carbonate, sodium bicarbonate and the like. The concentration ranges can vary from trace levels to saturation. Another example of an ionically conductive medium is a gel that is composed of 4 wt % acrylic acid neutralized with NaOH containing 96 wt % water. Numerous other fluid compounds and materials which may be desirable for use with the apparatus of the present invention are described in commonly assigned patent application entitled Photoconductive Charging Processes filed on May 27, 1994, identified by U.S. patent application Ser. No. 08/250,749.

As indicated hereinabove, a voltage bias is applied to the fluid media in the fluid reservoir 22 via DC power supply 26. Typical voltages applied to the fluid media might range from about −4000 V to about +4000 V, preferably between about ±400 to about ±700, and more preferably ranging from about −600 to about −675 volts. The voltage that is applied to the imaging member is essentially equal to the voltage applied to the fluid media such that a voltage of 750 volts, for example, applied to the ionically conductive medium results in a voltage of about 750 volts or slightly less on the imaging member. The voltage applied to the fluid media 24 by the power source 26 can be of a positive polarity or a negative polarity wherein the polarity of the charge which is deposited is exclusively controlled by the polarity of the voltage which is applied: the application of a positive bias to the ionically conductive fluid medium 24 causes positive ions to transfer to the imaging member while application of a negative bias to the ionically conductive fluid medium 24 causes negative ions to transfer to the imaging member.

Specific embodiments of the present invention are directed to a device for selectively placing the ionically conductive fluid medium in contact with the surface to be charged so as to enable the process of ion transfer through the fluid medium to charge, for example, a photoconductive imaging member, wherein ions are transported through the ionically conductive fluid medium to the surface of the imaging member as the imaging member is transported therepast, thereby enabling the transfer of ions to the member.

The ionically conductive fluid may be contacted to the imaging member in several ways. The fluid itself may be directly contacted with the photoreceptor surface by merely filling the fluid reservoir 22 to its maximum capacity such that a meniscus is formed just above the upper perimeter of the reservoir 22, allowing the fluid media 24 to impinge upon the surface of the photoreceptor through an opening in the container reservoir. In this embodiment, selective contact between the fluid media and the photoreceptor surface may be accomplished by selectively positioning the reservoir into and out of close proximity with the photoreceptor.

Numerous alternative means for contacting the fluid media to the photoreceptor may also be contemplated. One such alternative will be discussed in greater detail with respect to FIG. 2, wherein the fluid media 24 includes a ferrofluid of the type which exhibits an internal magnetic moment which can be spontaneously organized in a common direction under the influence of magnetic fields such that the position of the ionic conductive fluid media can be controlled via magnetic fields. In this alternative embodiment, the fluid media 24 comprises a ferrofluid material which is located within a reservoir having a small opening or aperture 23, wherein the aperture 23 is positioned opposite the imaging member 10. Preferably aperture 23 is provided in the form of a small slit which serves to confine the area of contact between the fluid media and the photoreceptor, and also serves to minimize the evaporation of the fluid from the reservoir. A magnet 29 is provided in the vicinity of the reservoir for controlling the position of the ferrofluid. In the illustrated embodiment, an electromagnet coupled to a biasing source 27 via switch 25 is positioned external to the reservoir 22 positioned opposite the aperture 23, separated from the reservoir 22 by the imaging member 10. With switch 25 closed, the electromagnet 29 is activated so as to cause the ferrofluid to be attracted toward the top of the reservoir 22 where the fluid exits through the aperture 23 in the reservoir 22. As should be understood from the foregoing discussion, the application of a voltage to the ferrofluid causes ions to be transferred to the imaging surface. Various alternative embodiments may also be contemplated, including: a permanent magnet which is selectively juxtapositioned adjacent to and away from the fluid reservoir by some mechanical mechanism for controlling the position of the ferrofluid; or a permanent magnet located within the reservoir and rotated for bringing the ferrofluid into and out of contact with the imaging member. In addition, the necessity for aperture 23 may be obviated via the exploitation of a well-known spiking phenomenon inherent to ferrofluids, wherein magnetic fields combine with surface instabilities in the ferrofluid to generate so called spicules which cause the ferrofluid to swell in predetermined areas. This phenomenon could be harnessed to create spicules which rise above the perimeter of the reservoir 22 and into contact with the imaging member 10.

Figure 3:
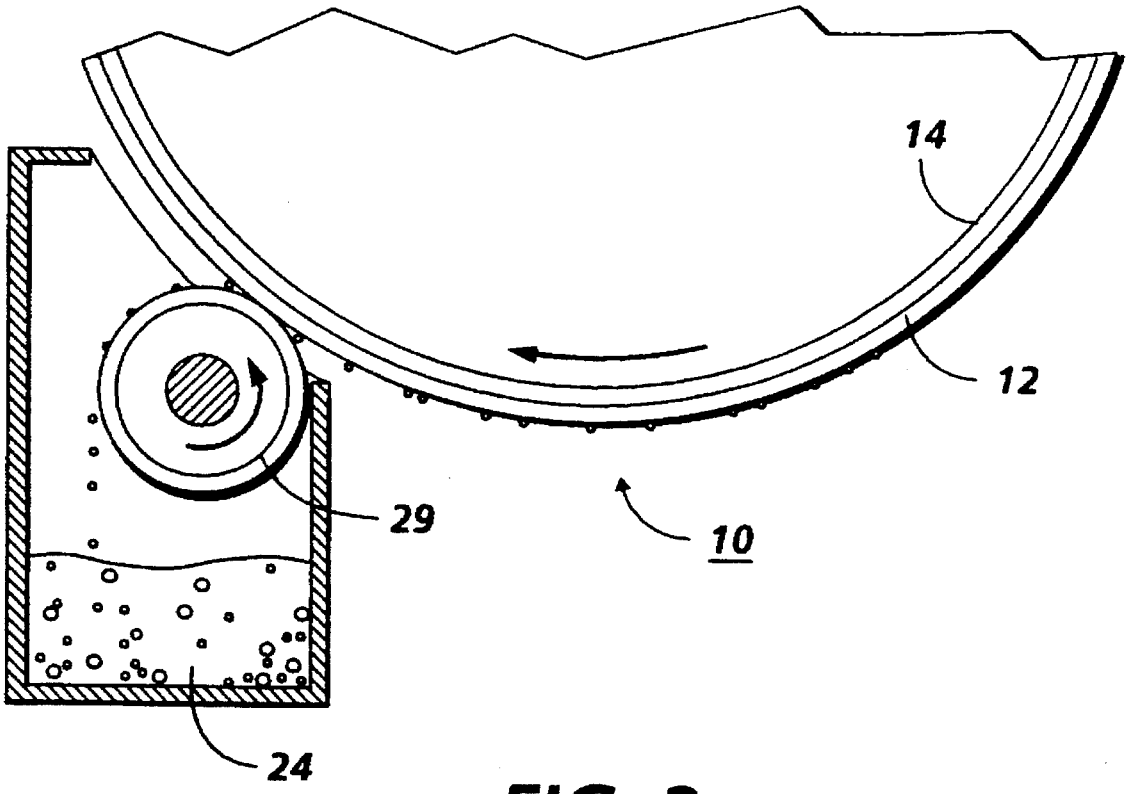
FIG. 3 is a schematic side view of a cleaning device that might be useful in combination with the alternative embodiment of the fluid media charging device of FIG. 2.

It is further noted that the ferrofluid-based embodiment described above may also benefit from a magnetic cleaner as shown in FIG. 3, comprising a rotatable magnet 29 positioned adjacent to the surface of the imaging member 10 for removing ferrofluid droplets which may become attached to the surface of the imaging member 10.

In operation, the device of the present invention enables ionic conduction charging of a photoconductive imaging member, or any dielectric member placed in contact therewith, by placing a fluid media component in contact with the surface of the photoconductive imaging member and applying a voltage to the fluid media component such that ions are transferred across the fluid media/imaging member interface to the imaging member. The imaging member thus becomes charged by the flow of ions through the fluid media component rather than by the spraying of ions onto the photoreceptor through a gaseous media as occurs in a corotron or like corona generating device. In simplest terms, the fluid media, such as an ionic liquid, is biased by a voltage approximately equal to the surface potential desired on the photoreceptor, causing ions to be deposited at the point of contact between the ionic liquid and the photoreceptor until the electric field across is completely diminished.

It is noted that the imaging member cannot be overcharged by the process disclosed in the present invention. The maximum voltage to which the imaging member can be charged is the voltage applied to the fluid media. The charging of the imaging member is limited to this value since the electric field across the bulk of the fluid medium, which drives the ions to the fluid/insulator interface, drops to zero when the voltage on the imaging member reaches the voltage applied to the fluid. Conversely, the imaging member can be undercharged if insufficient time is allowed for contact between the imaging member and the ionically conductive medium. The degree of undercharging is usually not significant (25–50 V) and can be compensated for by the application of a higher voltage to the ionically conductive medium. Moreover, it is noted that despite this voltage drop, the charge on the photoreceptor is uniform. The circumferential rotating speed of the photoreceptor can range from very low values like anything greater than zero speed to high speeds such as, for example, about 100 inches per second and preferably from zero to about 20 inches per second.

It will be understood that the present invention might also be used to eliminate the use of an erase lamp commonly utilized in a typical electrostatographic printing machine. Typically, an erase lamp is used to expose the photoreceptor after an imaging cycle for removing any residual charge thereon. The device of the present invention, however, could be used to accomplish the same result because the ionically conductive fluid medium is able to charge imaging members to any voltage including zero (0) volts. Thus, it is possible to ground the ionically conductive liquid and withdraw the image-wise residual charge remaining on the imaging member back into the ionic medium. Therefore, an erase lamp is not needed to photodischarge the residual charge. Moreover, since the charge applied by the present invention is non-cumulative, the erase function typically associated with electrostatographic processes may be completely eliminated as a new charge can be applied independent of any pre-existing residual charge on the imaging member. This will work as long as the imaging member does not trap charges internally.

In recapitulation, it should now be clear from the foregoing discussion that the apparatus of the present invention provides a novel charging device in which a fluid media is provided with a voltage potential, wherein the fluid media is placed in contact with a photoreceptor for depositing a relatively uniform charge thereon. One advantage of ion transfer via a fluid media relative to a corotron is that ozone production is very greatly reduced. At voltages between −800 V and 800 V a corona is not visually observable in a completely darkened room with the process of the present invention and absolutely no odor of ozone is detectable with the process of the present invention. Since organic photoreceptors are usually charged to less than −800 V, ion transfer charging is, for all practical purposes, ozoneless. Thus, the need for ozone management and filtration is mitigated such that the ionic charging device of the present invention presents a lower health hazard than a typical corotron generating charging device.

Another advantage of the processes of the present invention is that the complexity of the power supply can be diminished. Because it is not necessary to control the discharge of corona, only a DC voltage bias is applied to the fluid media. Thus, the power supply is simpler than typical charging systems which use an AC signal superimposed onto a DC signal. In addition, the voltages necessary to operate the present invention are lower than any other practical charging device.

Yet another advantage is the high degree of charge uniformity provide by the present invention. It is believed that the potential distribution on the dielectric being charged adjusts itself during the charging process in such a way that the undercharged areas tend to become "filled in" with the additional ions, leading to a uniform deposition of ions on the dielectric layer. It has been shown that the variation in surface voltage is plus or minus 1–2 volts over a MYLAR surface. The device has also been shown to be capable of uniformly charging a photoreceptor surface up to 20 inches per second.

It is, therefore, apparent that there has been provided, in accordance with the present invention, a fluid media charging device that fully satisfies the aims and advantages set forth hereinabove. While this invention has been described in conjunction with a specific embodiment thereof, it will be evident to those skilled in the art that many alternatives, modifications, and variations are possible to achieve the desired results. Accordingly, the present invention is intended to embrace all such alternatives, modifications, and variations which may fall within the spirit and scope of the following claims.

We claim:

1. An apparatus for charging a member, comprising:

a fluid media including a ferrofluid material;

means for storing said fluid media;

means, including an electromagnet, for selectively contacting said fluid media with the member to be charged; and means for applying an electrical bias to said fluid media, wherein the electrical bias transports ions through said fluid media to the member to be charged for transferring ions thereto.

2. The device of claim 1, wherein the fluid media includes an ionically conductive liquid.

3. The device of claim 1, wherein said means for storing said fluid media includes:

a nonconductive vessel; and a conductive nipple extending into said nonconductive vessel for coupling said electrical bias applying means to said fluid media.

4. The device of claim 1, wherein said means for storing said fluid media includes a conductive vessel, said electrical bias applying means being coupled directly to said conductive vessel for applying the electrical bias to said fluid media.

5. The device of claim 1, wherein the member to be charged includes a photoconductive imaging member.

6. The device of claim 1, wherein said means for applying an electrical bias to said fluid media includes a DC voltage power supply.

7. An electrostatographic printing apparatus including a charging device for applying an electrical charge to an imaging member, comprising:

a fluid media including a ferrofluid material;

means for storing said fluid media;

means, including an electromagnet, for selectively contacting said fluid media with the imaging member; and means for applying an electrical bias to said fluid media, wherein the electrical bias transports ions through said fluid media to the imaging member for transferring ions thereto.

8. The electrostatographic printing apparatus of claim 7, wherein the fluid media includes an ionically conductive liquid.

9. The electrostatographic printing apparatus of claim 7, wherein said means for storing said fluid media includes a nonconductive vessel; and a conductive nipple extending into said nonconductive vessel for coupling said electrical bias applying means to said fluid media.

10. The electrostatographic printing apparatus of claim 7, wherein said means for storing said fluid media includes a conductive vessel, said electrical bias applying means being coupled directly to said conductive vessel for applying the electrical bias to said fluid media.

11. The electrostatographic printing apparatus of claim 7, wherein said means for applying an electrical bias to said fluid media includes a DC voltage power supply.

* * * * *